US010018417B2

(12) United States Patent
Turrini-Rochford et al.

(10) Patent No.: US 10,018,417 B2
(45) Date of Patent: Jul. 10, 2018

(54) HAND DRYER

(71) Applicant: Dyson Technology Limited, Wiltshire (GB)

(72) Inventors: Tim Turrini-Rochford, Bristol (GB); Stuart James Steele, Bristol (GB); Stephen Benjamin Courtney, Bath (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 316 days.

(21) Appl. No.: 14/085,548

(22) Filed: Nov. 20, 2013

(65) Prior Publication Data

US 2014/0141710 A1 May 22, 2014

(30) Foreign Application Priority Data

Nov. 21, 2012 (GB) ..... 1220893.0

(51) Int. Cl.
*F26B 21/00* (2006.01)
*A47K 10/48* (2006.01)

(52) U.S. Cl.
CPC ..... *F26B 21/004* (2013.01); *A47K 10/48* (2013.01)

(58) Field of Classification Search
CPC ..... F26B 21/00
USPC ..... 454/284
See application file for complete search history.

(56) References Cited

U.S. PATENT DOCUMENTS 2,935,244 A * 5/1960 Dills ..... F25B 31/02 181/202
2,973,895 A 3/1961 Brown et al.
3,711,958 A 1/1973 Lepage
4,750,860 A * 6/1988 Kelley ..... F04D 29/664 181/205
4,786,299 A * 11/1988 DeMarco ..... A47L 9/0081 181/256
4,807,718 A * 2/1989 Lotz ..... F04D 29/668 181/202
5,266,753 A * 11/1993 Muschelknautz ..... F01N 1/125 181/224

(Continued)

FOREIGN PATENT DOCUMENTS

BE 347407 12/1927
CN 2673262 1/2005

(Continued)

OTHER PUBLICATIONS

JP10080378A Translation.*

(Continued)

*Primary Examiner* — Gregory Huson
*Assistant Examiner* — Martha Becton
(74) *Attorney, Agent, or Firm* — Morrison & Foerster LLP

(57) ABSTRACT

The present invention relates to a hand dryer for drying a user's hands by means of an airflow discharged through an air outlet on the hand dryer. The airflow is generated by a motor-driven fan unit, the airflow exiting the fan unit through a fan outlet on the fan unit. The fan unit is mounted to a fixed part of the hand dryer by means of an inflatable mount secured to the fixed part. The mount incorporates at least one inflatable duct connecting the fan outlet to the air outlet, which inflatable duct is, in use, inflated by the airflow passing from the fan outlet to the air outlet to provide pneumatic support for the fan unit.

15 Claims, 17 Drawing Sheets

(56) References Cited

U.S. PATENT DOCUMENTS

| | | | | |
|---|---|---|---|---|
| 5,383,599 | A | 1/1995 | Zur | |
| 5,987,773 | A * | 11/1999 | Lipscy | E06B 59/42 34/106 |
| 6,351,380 | B1 * | 2/2002 | Curlee | F16B 5/065 165/80.3 |
| 6,352,247 | B1 | 3/2002 | Ishikawa et al. | |
| 6,371,738 | B2 * | 4/2002 | Jones | 417/363 |
| 6,497,267 | B1 * | 12/2002 | Azar | E06B 9/42 160/188 |
| 6,894,897 | B1 * | 5/2005 | Nagurny | H05K 7/20172 165/122 |
| 8,167,541 | B2 | 5/2012 | Park et al. | |
| 8,839,786 | B2 * | 9/2014 | Heidmann | A61M 16/0057 128/204.18 |
| 2002/0178531 | A1 * | 12/2002 | Plomteux | A47L 5/38 15/326 |
| 2006/0018575 | A1 | 1/2006 | Yum et al. | |
| 2006/0038106 | A1 | 2/2006 | Geroux et al. | |
| 2006/0125330 | A1 | 6/2006 | Winkler et al. | |
| 2006/0131101 | A1 * | 6/2006 | Crocker | F04D 29/664 181/224 |
| 2006/0186225 | A1 * | 8/2006 | Bartholmey | F24F 7/065 239/499 |
| 2008/0016646 | A1 * | 1/2008 | Gagnon | A47L 5/38 15/301 |
| 2009/0034946 | A1 * | 2/2009 | Caine | A47K 10/48 392/380 |
| 2009/0285672 | A1 | 11/2009 | Park et al. | |
| 2010/0006097 | A1 | 1/2010 | Frater et al. | |
| 2011/0070108 | A1 | 3/2011 | Arita et al. | |
| 2013/0097885 | A1 | 4/2013 | Dyson et al. | |
| 2013/0269208 | A1 * | 10/2013 | Gammack | F26B 21/004 34/523 |
| 2013/0276328 | A1 * | 10/2013 | Gammack | A47K 10/48 34/523 |
| 2013/0334824 | A1 | 12/2013 | Freda | |
| 2015/0320268 | A1 | 11/2015 | Steele et al. | |

FOREIGN PATENT DOCUMENTS

| | | |
|---|---|---|
| CN | 201322009 | 10/2009 |
| EP | 2 412 284 | 2/2012 |
| EP | 2 515 418 | 10/2012 |
| GB | 549766 | 12/1942 |
| JP | 9-98907 | 4/1997 |
| JP | 10-80378 | 3/1998 |
| JP | 11-113789 | 4/1999 |
| JP | 2000-93347 | 4/2000 |
| JP | 2000-234586 | 8/2000 |
| JP | 2000-304094 | 10/2000 |
| JP | 2002-28100 | 1/2002 |
| WO | WO-2010/088975 | 8/2010 |

OTHER PUBLICATIONS

International Search Report and Written Opinion dated Feb. 4, 2014, directed to International Application No. PCT/GB2013/052915; 7 pages.

Search Report dated Mar. 14, 2013, directed to GB Application No. 1220893.0; 1 page.

Steele et al., U.S. Office Action dated May 3, 2017, directed to U.S. Appl. No. 14/646,676; 31 pages.

* cited by examiner $\underline{F}_{\Delta M}$ (Blower) = $\dot{m}\underline{V}_{out} - \dot{m}\underline{V}_{in}$ $\underline{F}_{\Delta P}$ (Blower) = $\Delta P_{Blower}\underline{A}$

HAND DRYER

REFERENCE TO RELATED APPLICATIONS

This application claims the priority of United Kingdom Application No. 1220893.0, filed Nov. 21, 2012, the entire contents of which are incorporated herein by reference.

FIELD OF THE INVENTION

The present invention relates to the field of hand dryers.

BACKGROUND OF THE INVENTION

There are various designs of hand dryer on the market, which are typically installed in public washrooms as an alternative to paper towels.

Hand dryers rely on airflow to dry a user's hands. The airflow is typically discharged through one or more air outlets on the hand dryer and the user holds the hands in close proximity to the air outlet(s) so that the airflow is directed onto the user's hands to provide a drying effect.

The principal drying mechanism may differ between different types of hand dryer. The drying mechanism may be evaporative, in which case the airflow will tend to be heated. Alternatively, the drying mechanism may rely mainly on a momentum-drying effect at the surface of the hands, in which case the airflow will tend to be discharged at high velocity (in excess of 80 m/s, and typically in excess of 140 m/s).

In each case, the airflow is often generated using a motor-driven fan unit which is located inside the hand dryer.

The fan unit will often be relatively heavy, and subject to vibration in use (caused by rotor imbalance etc.). This may generate excessive noise in a washroom environment, which is undesirable.

SUMMARY OF THE INVENTION

According to the present invention, there is provided a hand dryer for drying a user's hands by means of an airflow discharged through an air outlet on the hand dryer, the airflow being generated by a motor-driven fan unit, the airflow exiting the fan unit through a fan outlet on the fan unit, the fan unit being mounted to a fixed part of the hand dryer by means of an inflatable mount secured to the fixed part, the mount comprising at least one inflatable duct connecting the fan outlet to the air outlet, which inflatable duct is, in use, inflated by the airflow passing from the fan outlet to the air outlet to provide pneumatic support for the fan unit.

Thus, the inflatable mount acts as a pneumatic damper for the fan unit in use. This reduces vibration transmission externally through the mount compared to conventional hard-mounting schemes.

The primary airflow is utilised to inflate the inflatable duct, by connecting the inflatable duct between the fan outlet and the air outlet. Consequently, internal pressurization of the inflatable duct in use is effectively controlled by the area of the air outlet. This is a simple, cost-effective arrangement for providing pneumatic support for the fan unit—no bleed paths, valves or separate pneumatic circuit is required.

The airflow may be discharged through the air outlet via an orifice in the fixed part of the hand dryer, the inflatable duct being arranged to connect the fan outlet to the orifice, the area of the orifice being smaller than the cross-sectional area of the inflatable duct adjacent the fan outlet. This effectively introduces a restriction to the airflow upstream of the air outlet for more rapid pressurization of the inflatable mount on start-up. In addition, it helps to reduce the pressure force exerted directly on the inflatable mount.

The fan unit may sit on top of the inflatable mount, so that the inflatable mount helps to support the weight of the fan unit.

The inflatable mount may comprise more than one inflatable duct.

Alternatively, the mount may comprise just a single duct. In this case, the mount may take the form of a single inflatable airflow duct, so that the inflatable duct itself constitutes the inflatable mount. This is a very simple arrangement. In this arrangement, the fan unit may be arranged to sit on the inflatable duct, which duct is arranged end-to-end underneath the fan unit to form a pneumatic supporting column. Thus, the inflatable duct helps support the weight of the fan unit. The duct is preferably substantially vertical. The fan outlet may be located on the underside of the fan unit for discharging air directly down into the inflatable duct; this sort of direct discharge path helps reduce pressure losses associated with a convoluted discharge path.

The inflatable duct is preferably an elastomeric duct, though this is not essential. For example, the inflatable duct may comprise a combination of rigid sections and flexible sections which nevertheless allow inflation of the duct to provide pneumatic support.

The inflatable duct may fit over the outside of the fan unit like a sleeve, the end of the duct being held in place by a collar which mechanically clamps the end of the duct against the outside of the fan unit. This is a compact, low profile arrangement for securing the fan unit to the mount.

The duct may taper from the fan outlet to the air outlet, to provide a smooth transition between the fan outlet and the air outlet. This helps reduces pressure losses inside the duct. For example, in a particular embodiment, the inflatable duct is funnel-shaped. A funnel shape—by virtue of its circular symmetry—also helps ensure the mount provides a uniform, symmetric damping response.

The hand dryer may be a high-pressure hand dryer of the type which relies on a high momentum drying effect at the surface of the hands. Thus, the airflow may be discharged through the air outlet at a velocity in excess of 80 m/s, preferably in excess of 140 m/s. Airflow pressures upstream of the air outlet may be up to 40 kPa. The invention finds particular application in these high-pressure hand dryers, where the fan unit may be subject to a significant up-thrust on start-up. This high fan thrust will result in rapid pressurization of the inflatable mount, which in turn will proportionally react against and resist upward displacement of the fan unit.

The hand dryer may be in the form of an air-knife hand dryer in which the air outlet is an air-knife discharge outlet. The air-knife discharge outlet may comprise one or more slit-like discharge apertures. This air-knife discharge outlet is preferably arranged to span a user's hand; for example, the outlet may have a span of 80 mm or more.

The fixed part may form part of, or be secured to, the external casing of the hand dryer.

The hand dryer may be a wall-mountable hand dryer. It is particularly advantageous in such dryers to reduce vibration transmission externally of the fan unit, because vibrations can be transmitted to the wall in use.

BRIEF DESCRIPTION OF THE DRAWINGS

Embodiments of the invention will now be described, by way of example, with reference to the accompany drawings, in which.

DETAILED DESCRIPTION OF THE INVENTION

Hand Dryer

Figure 1:
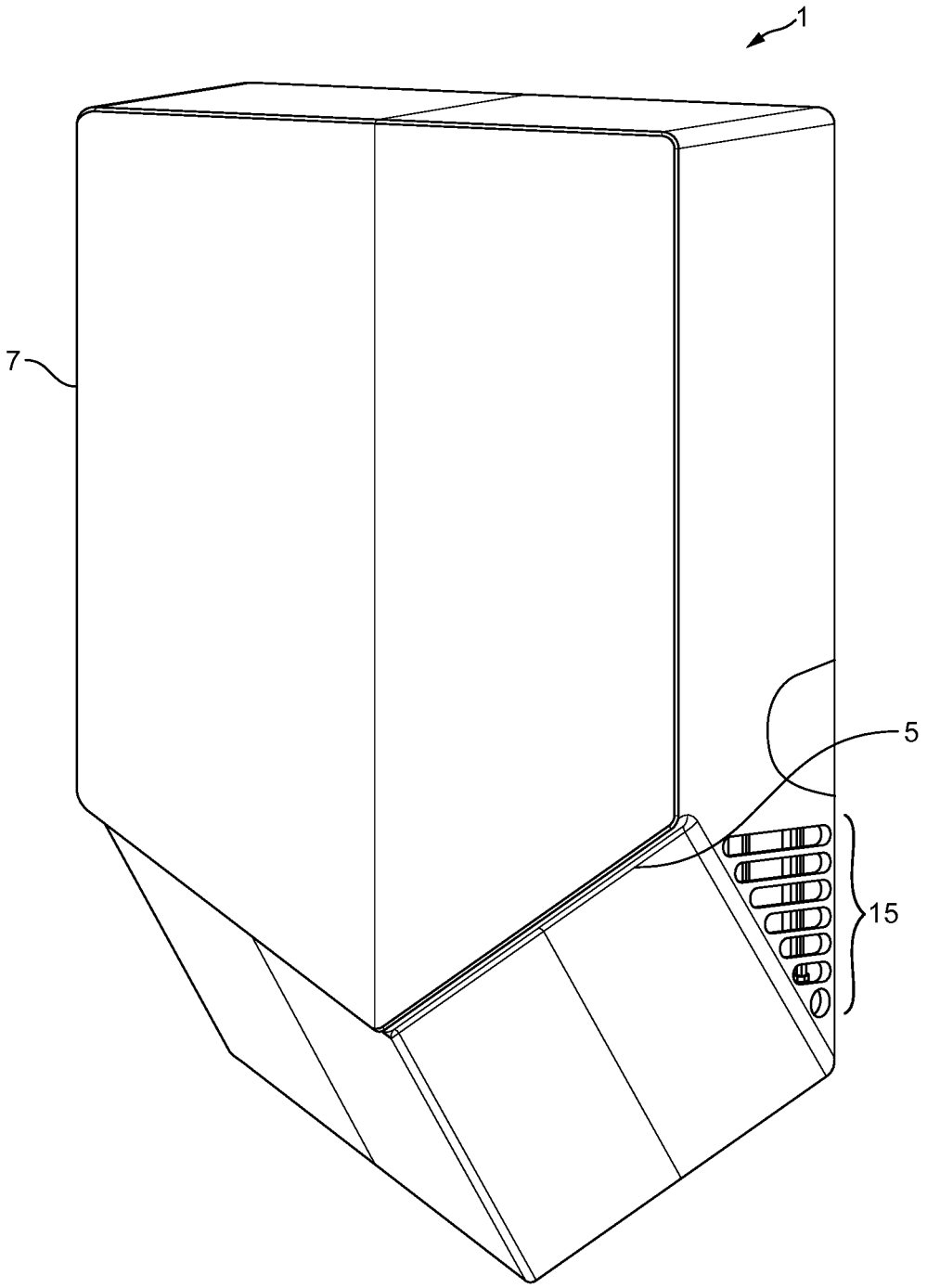
FIG. 1 is a parallel-projected view showing a hand dryer in accordance with the present invention.
Figure 2:
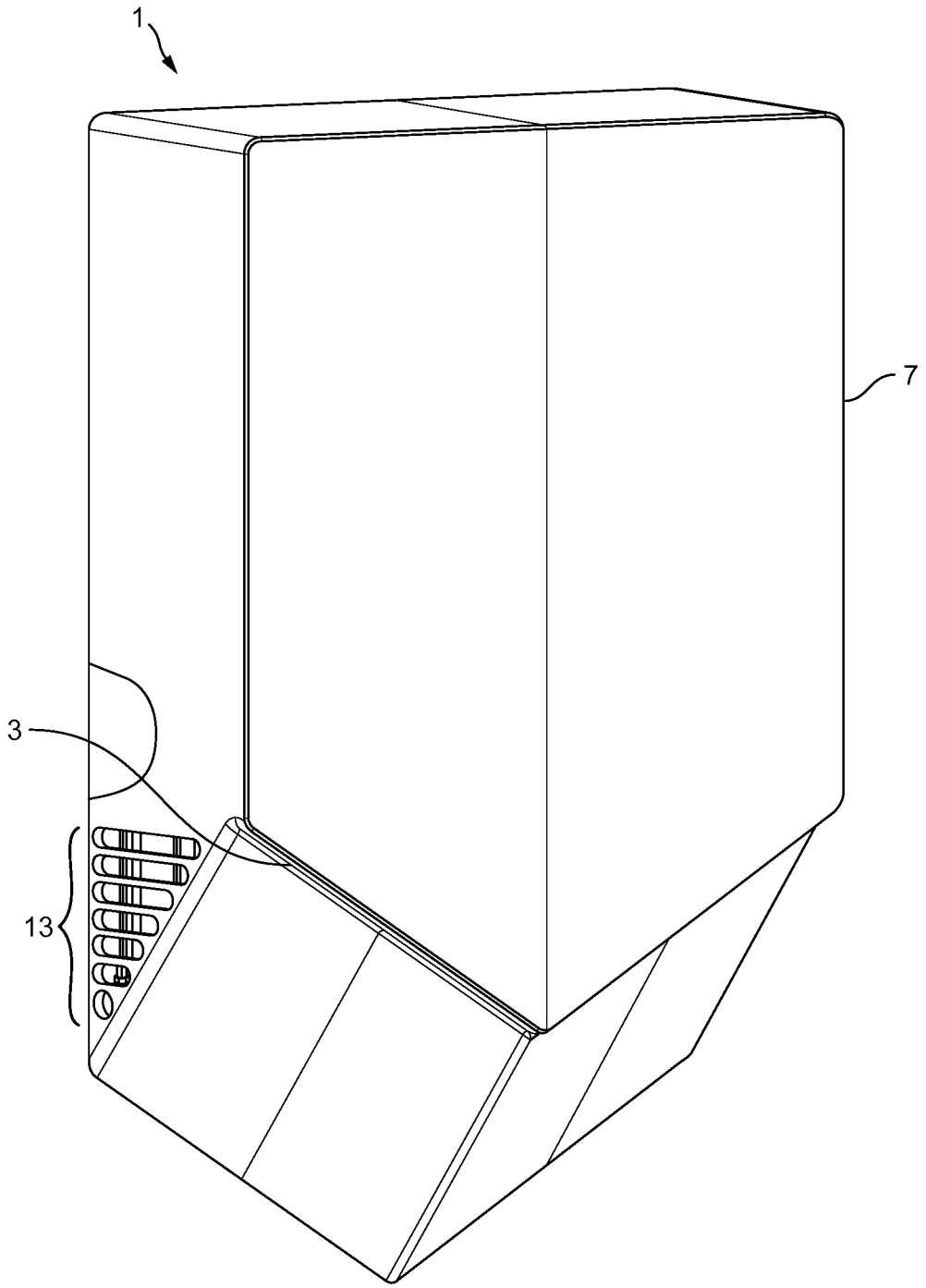
FIG. 2 is a parallel-projected view of the same hand dryer from a reverse angle.
Figure 3:
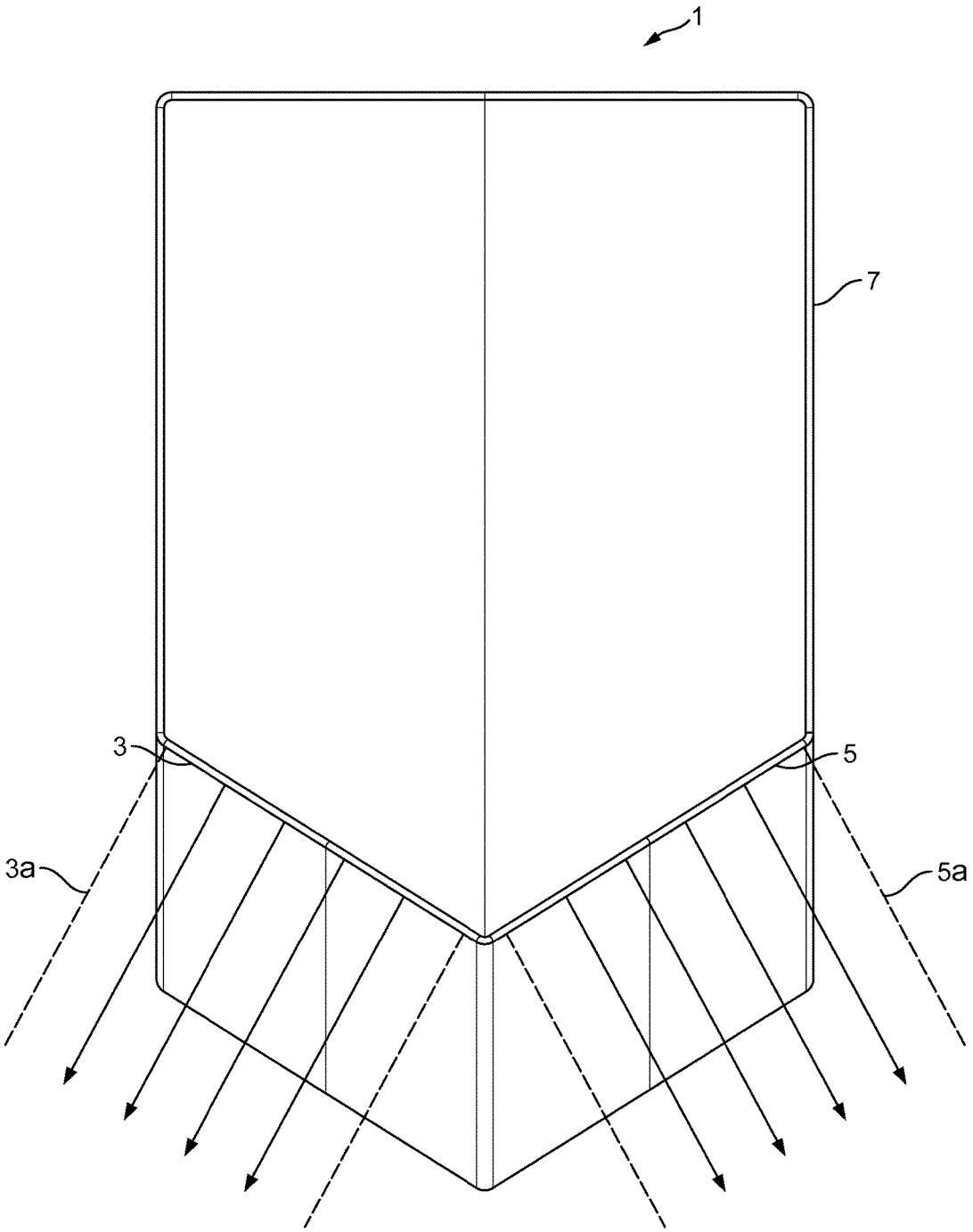
FIG. 3 is a front view of the hand dryer, illustrating discharge of an airflow through an air outlet on the hand dryer in use.

FIGS. 1-3 show a wall-mountable hand dryer 1 in accordance with the invention.

The hand dryer 1 discharges an airflow to dry the user's hands. The airflow is discharged at high speed (>80 m/s) through two air outlets 3, 5 on the hand dryer 1. Each outlet 3, 5 takes the form of an air-knife discharge outlet: in this case a narrow slit—less than 2 mm wide—which is machined directly into the external casing 7 of the hand dryer 1. The airflow is thus discharged as two thin, high velocity sheets of air (FIG. 3) or "air-knives" 3*a*, 5*a*.

The mode of operation of the hand dryer 1 is analogous to the established use of air knives in industry to remove debris or liquid from the surface of a product (see e.g. EP2394123A1, which describes removal of debris from a glass sheet using air knives): each air-knife moves across the surface of a respective hand and, as it does so, wipes or scrapes the water from the surface of the hand.

The hands are inserted palm-open underneath the air-knife discharge outlets 3, 5—one hand under each outlet—and then withdrawn slowly to effect the required relative movement between the hands and the air-knives. This process is repeated for both sides of the hands. To make the hand dryer 1 more comfortable to use, the air-knife discharge outlets 3, 5 are arranged in a V-configuration viewed from the front of the dryer 1 (FIG. 3). This helps prevent excessive supination of the forearm in use.

Figure 9:
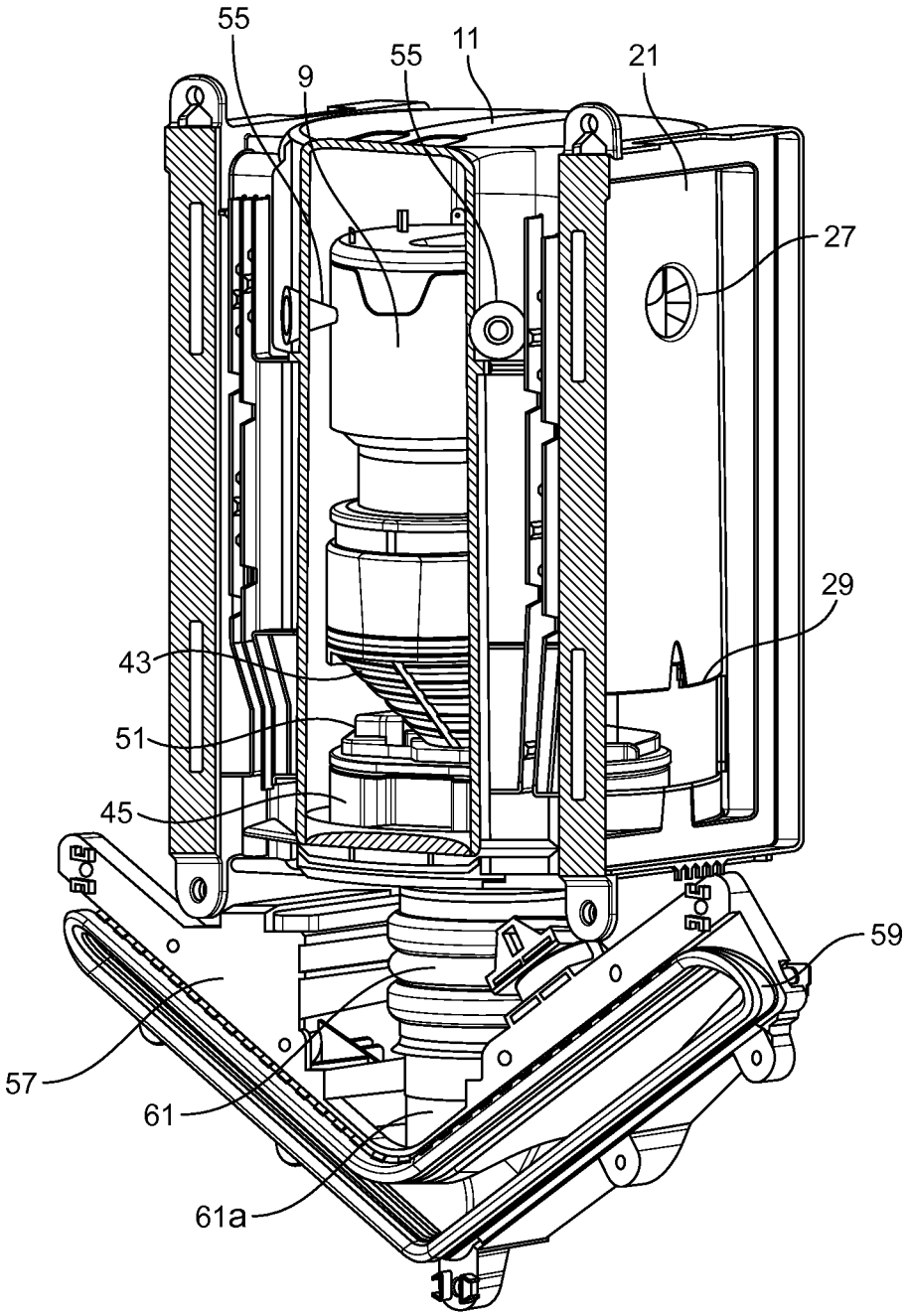
FIG. 9 is a parallel-projected view corresponding to FIG. 8, but partially sectioned to shown a fan unit and an inflatable mount inside a motor bucket.

The airflow is generated by a motor-driven fan unit in the form of a centrifugal blower (or compressor) 9. The centrifugal blower 9 is housed inside a motor bucket 11 inside the external casing 7 of the hand dryer 1. You can see the centrifugal blower 9 and motor bucket 11 in FIG. 9.

Twin Air-Filtered Intakes

Figure 4:
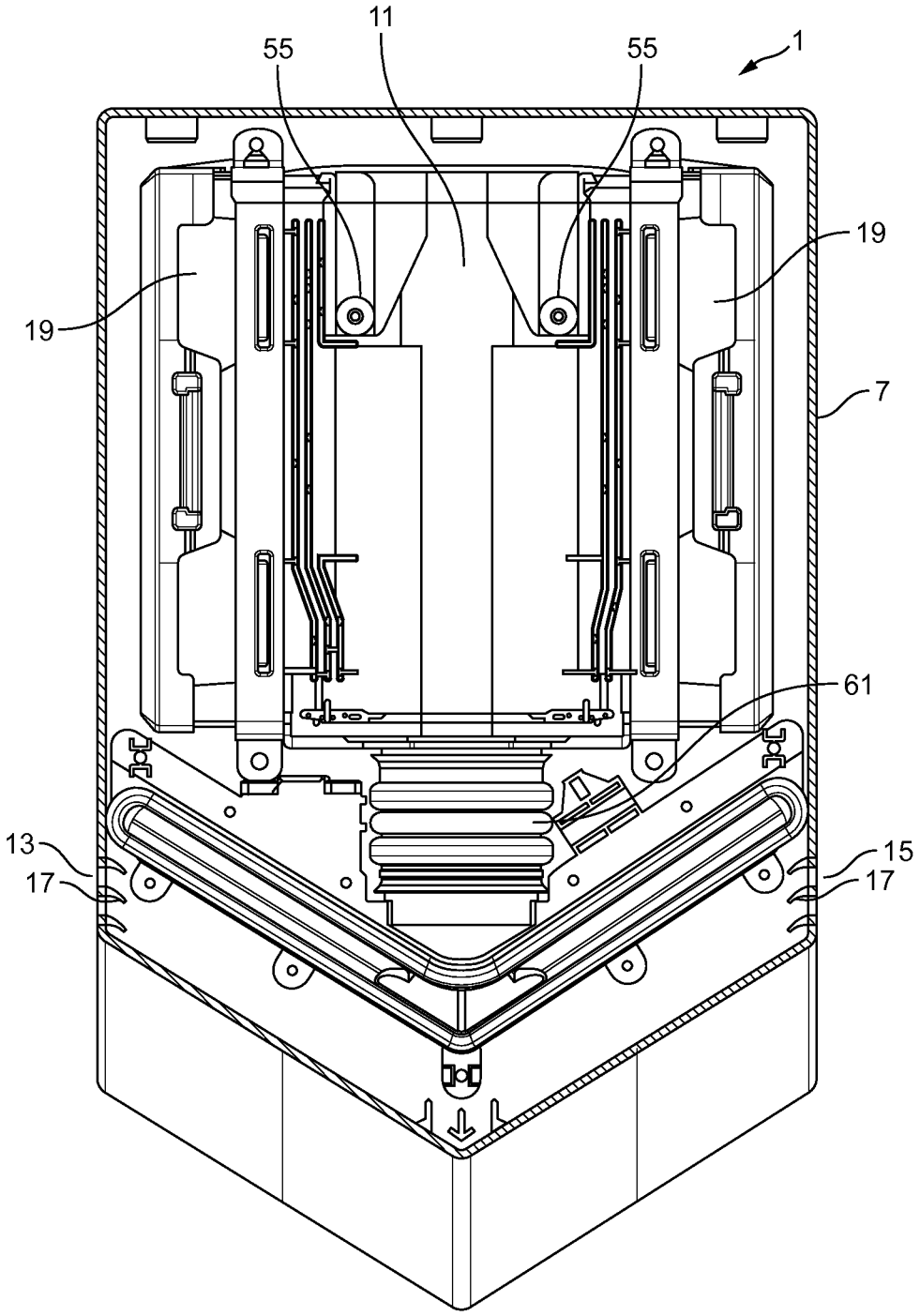
FIG. 4 is a front view of the hand dryer, but with the external casing sectioned to reveal various internal components of the hand dryer.
Figure 5:
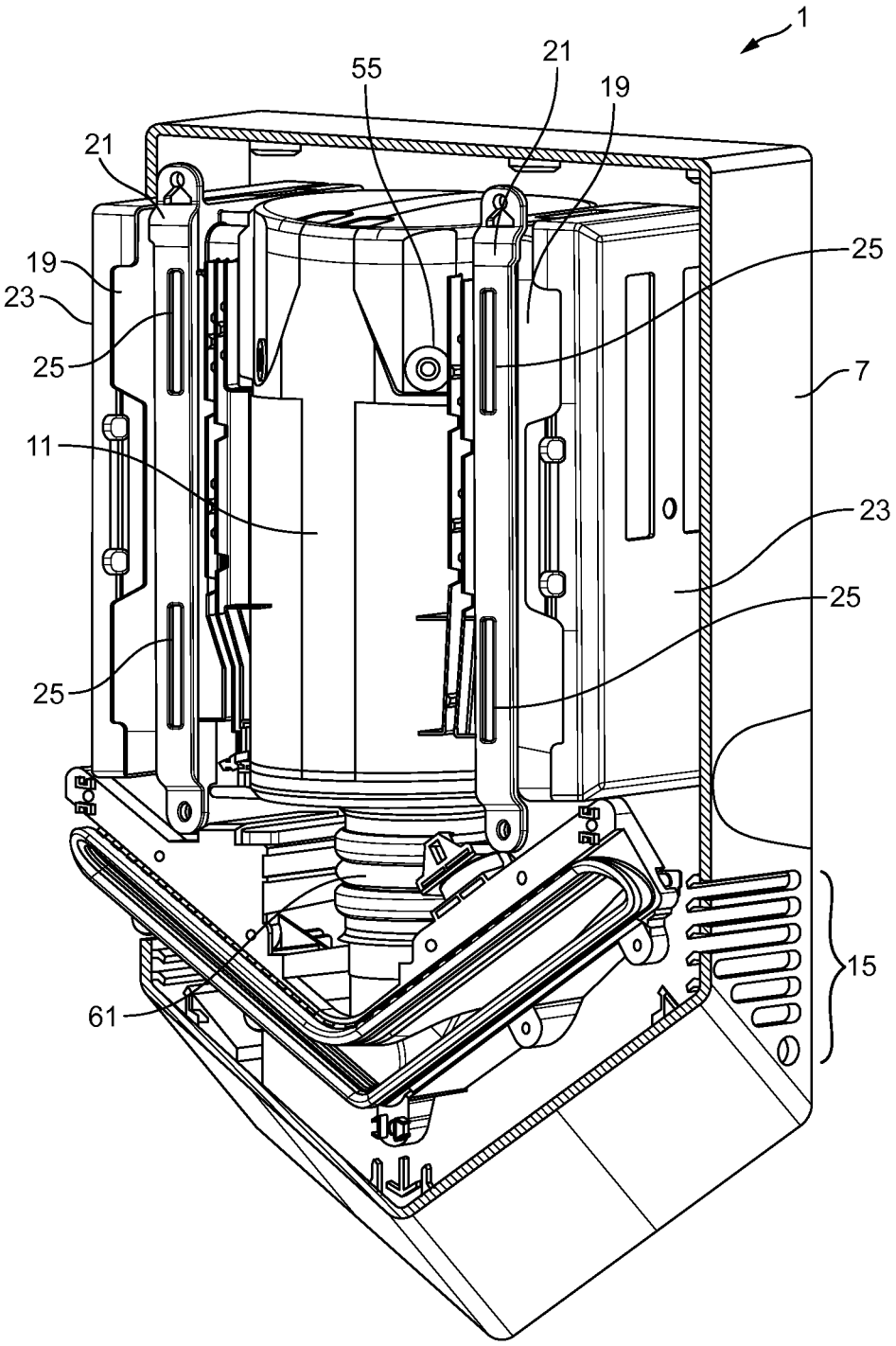
FIG. 5 is a parallel-projected view corresponding to FIG. 4.

The airflow is drawn in by the centrifugal blower 9 through two intakes 13, 15 in the external casing 7 of the hand dryer 1. You can see one of these intakes, 15, in FIG. 1 and the other intake, 13, in FIG. 2. Both of them are visible in FIG. 4, which also shows a series of shroud flaps 17 on the internal side of each intake: intended to help prevent foreign objects being inserted through the intakes 13, 15.

The intakes 13, 15 feed into the motor bucket 11 via two rectangular, planar HEPA filters 19, provided either side of the motor bucket 11. Each filter 19 is sandwiched between a respective inner filter cover 21 and an outer filter cover 23. The filters 19 are thus arranged in plane-parallel configuration either side of the motor bucket 11.

In each case, the inner filter cover 21 is a rectangular cover which forms part of the motor bucket 11. The filter 19 has a rigid frame which clips onto this inner cover (you can see the clips 25 in FIG. 4). Two apertures are provided in the inner filter cover 21: an upper, circular aperture 27 and a lower, generally rectangular aperture 29. These two apertures 27, 29 effectively form a filter outlet through which air exiting the respective filter 19 may pass into the motor bucket 11.

The outer cover 23 is a separate rectangular cover which slips onto the outside of the frame of the respective filter 19. Two parallel rectangular slots 31 are formed in the outer cover 23. These two slots 31 effectively form a filter inlet through which air from the intakes 13, 15 may enter the respective filter 19.

The filter 19 and the outer cover 23 are arranged so that there is a space—or manifold—in between the upstream surface of the filter 19 and the outer cover 23. This helps prevent uneven loading of the filter 19 in use. The inner cover 21 may likewise form a space—or manifold—across the downstream surface of the filter 19.

The filter inlet and filter outlet in each case combine to form an intake path to the blower 9 inside the motor bucket 11. Thus, there are two parallel intake paths: one through each of the two air-filters 19.

In each case the filter inlet is offset from the filter outlet so that there is no line of sight through the filter outlet and the respective filter inlet: the lower rectangular aperture 29 in the inner cover 21 is positioned somewhat below the vertical slots 31 forming the respective filter inlet whereas the upper, circular aperture 27 is positioned in-between the vertical slots 31 forming the respective filter inlet. In effect, each air intake path to the blower 9 follows a convoluted path through the respective filter 19.

The filters 19 are individually replaceable: each one can be removed simply by unclipping it from the inner cover 21 and once removed, a new filter can then be clipped onto the inner cover 21 in its place (the outer cover 23 can also be unclipped and re-used, or else may be disposable).

Soft-Mounting Arrangement for Fan Unit

Figure 13:
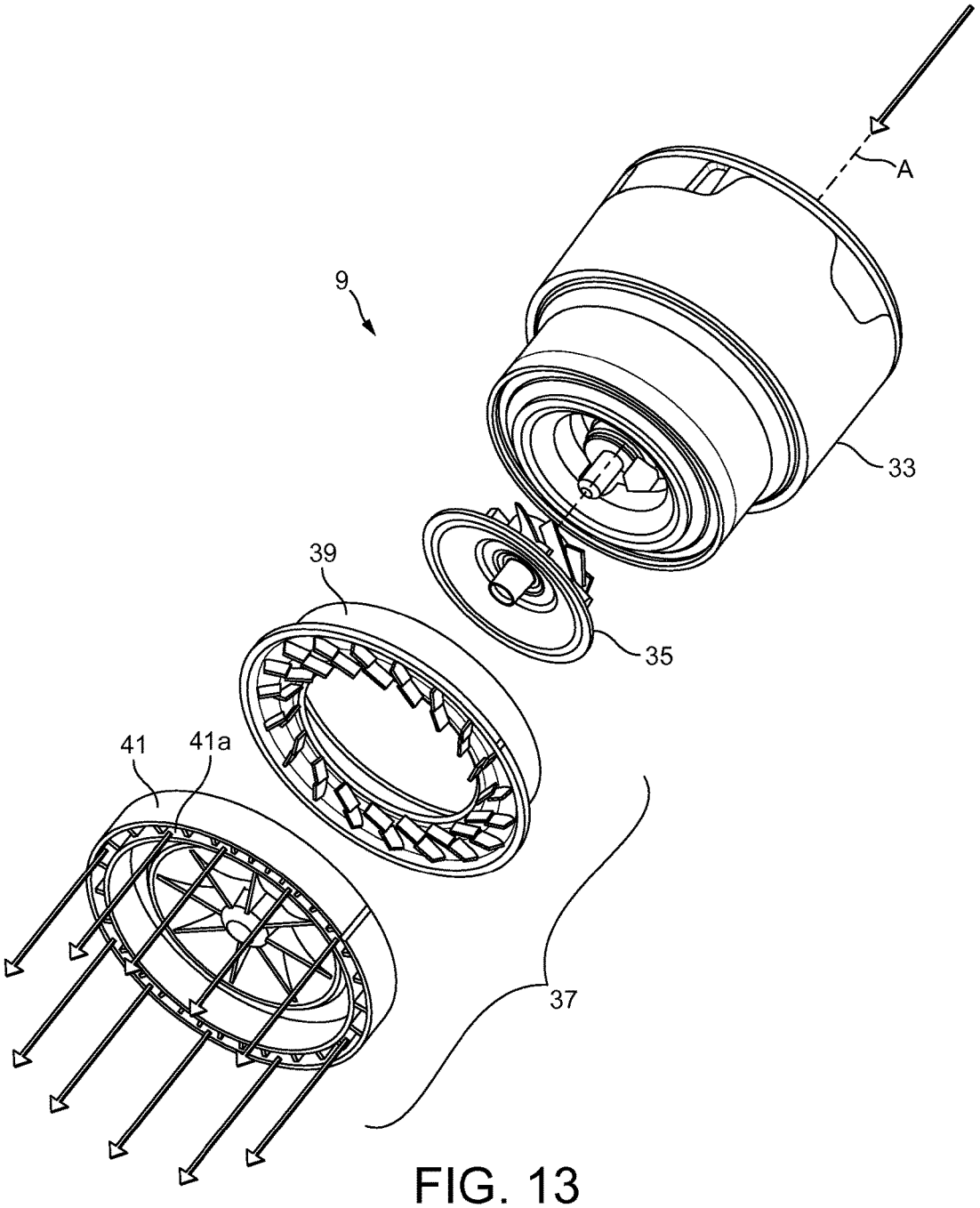
FIG. 13 is an exploded view of the fan unit, showing an impeller arranged along a fan axis and a diffuser defining an annular fan outlet.

An exploded view of the centrifugal blower 9 is shown in FIG. 13. It comprises a drive unit 33 incorporating an electric motor (not shown), a centrifugal fan impeller 35 which connects to the output shaft of the motor, and a diffuser 37. The diffuser comprises a diffuser ring 39, incorporating a number of swirl vanes for static pressure recovery, and a diffuser cap 41 which fits onto the diffuser ring 39 and which channels airflow from the impeller 35 out through an annular fan outlet 41*a*, as indicated by the arrows (in use, there will be a certain degree of residual swirl to the airflow as it leaves the fan outlet 41*a*—not illustrated in FIG. 13).

The centrifugal blower 9 is soft-mounted vertically inside the motor bucket 11, with the fan outlet 41*a* facing downwards and the rotation axis A of the impeller 35 extending vertical.

The soft-mounting arrangement for the centrifugal blower 9 comprises an upper soft-mounting assembly and a lower soft-mounting assembly.

The lower soft-mounting assembly takes the form of an elastomeric duct 43 which extends end-to-end underneath the centrifugal blower 9. The duct 43 is funnel-shaped, having a relatively large cross-section at the top (adjacent the fan outlet 41*a*), but tapering to a relatively small cross-section at the bottom.

The upper end of the duct 43 fits around the diffuser 37 like a sleeve and is clamped in position using a cable-tie (not shown).

Figure 6:
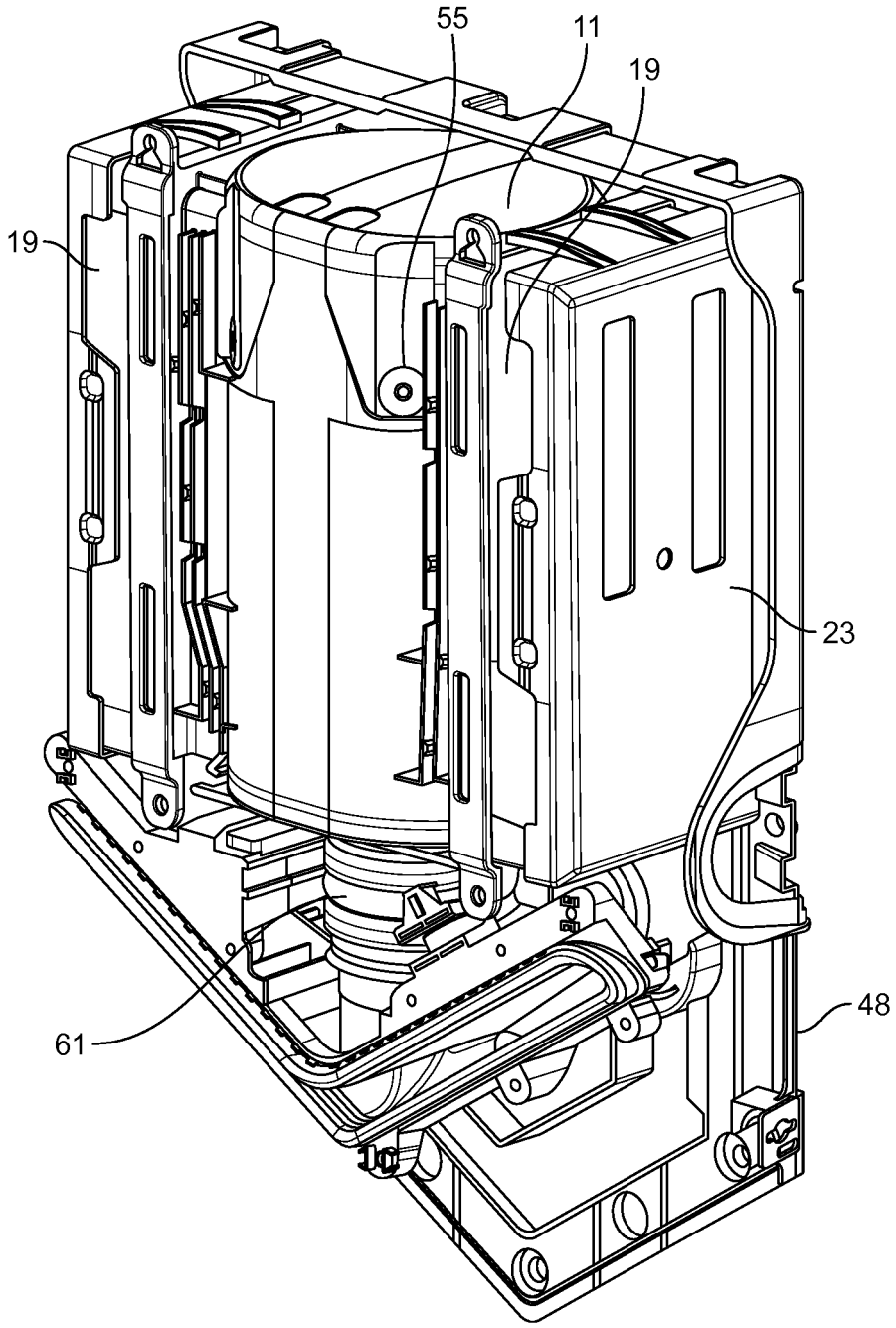
FIG. 6 is a parallel-projected view of the hand dryer with the fascia removed, illustrating mounting of various internal components on a back-plate of the hand dryer.
Figure 7:
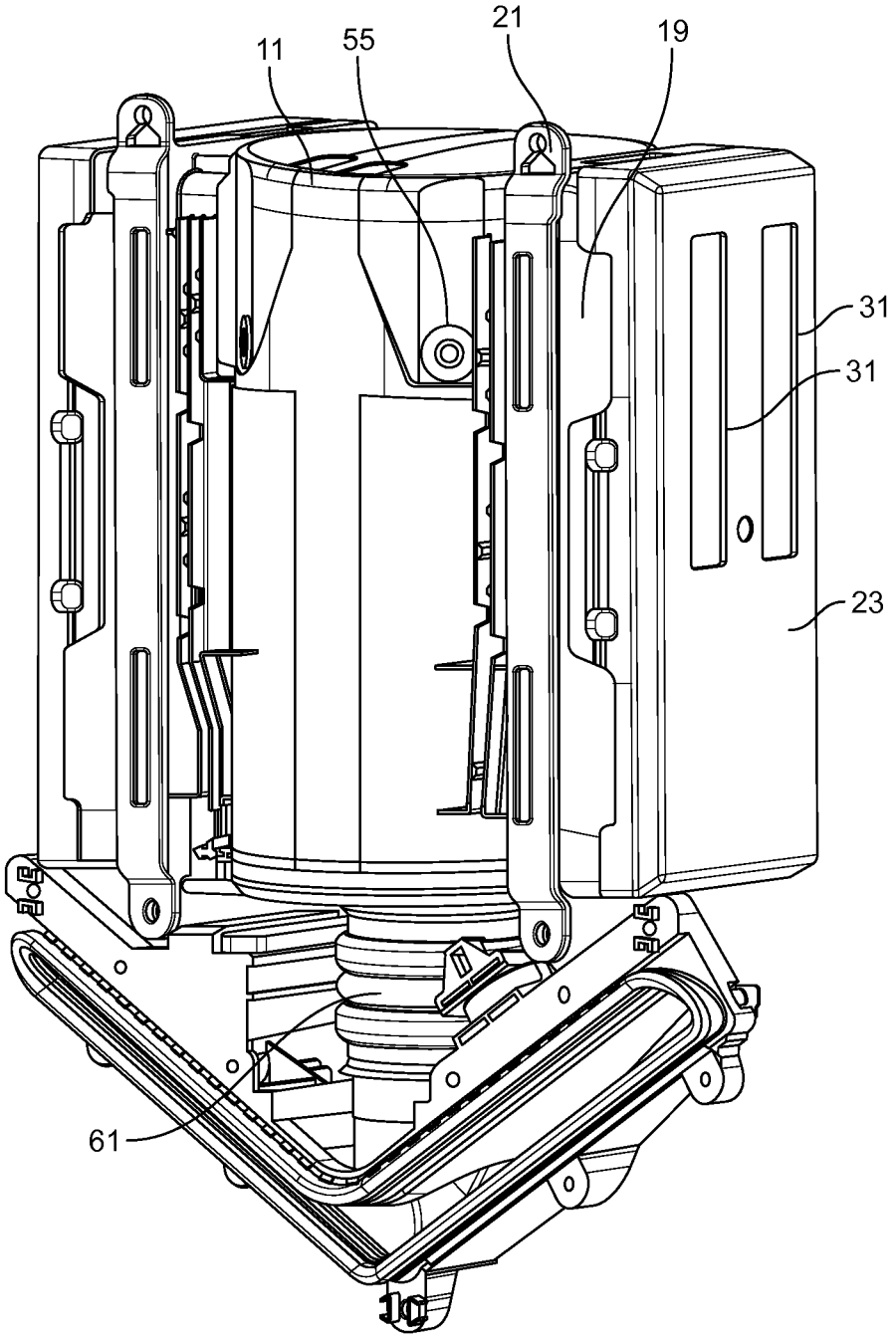
FIG. 7 is a parallel-projected view showing various internal components of the hand dryer—notably an air-filter in the primary airflow path.
Figure 8:
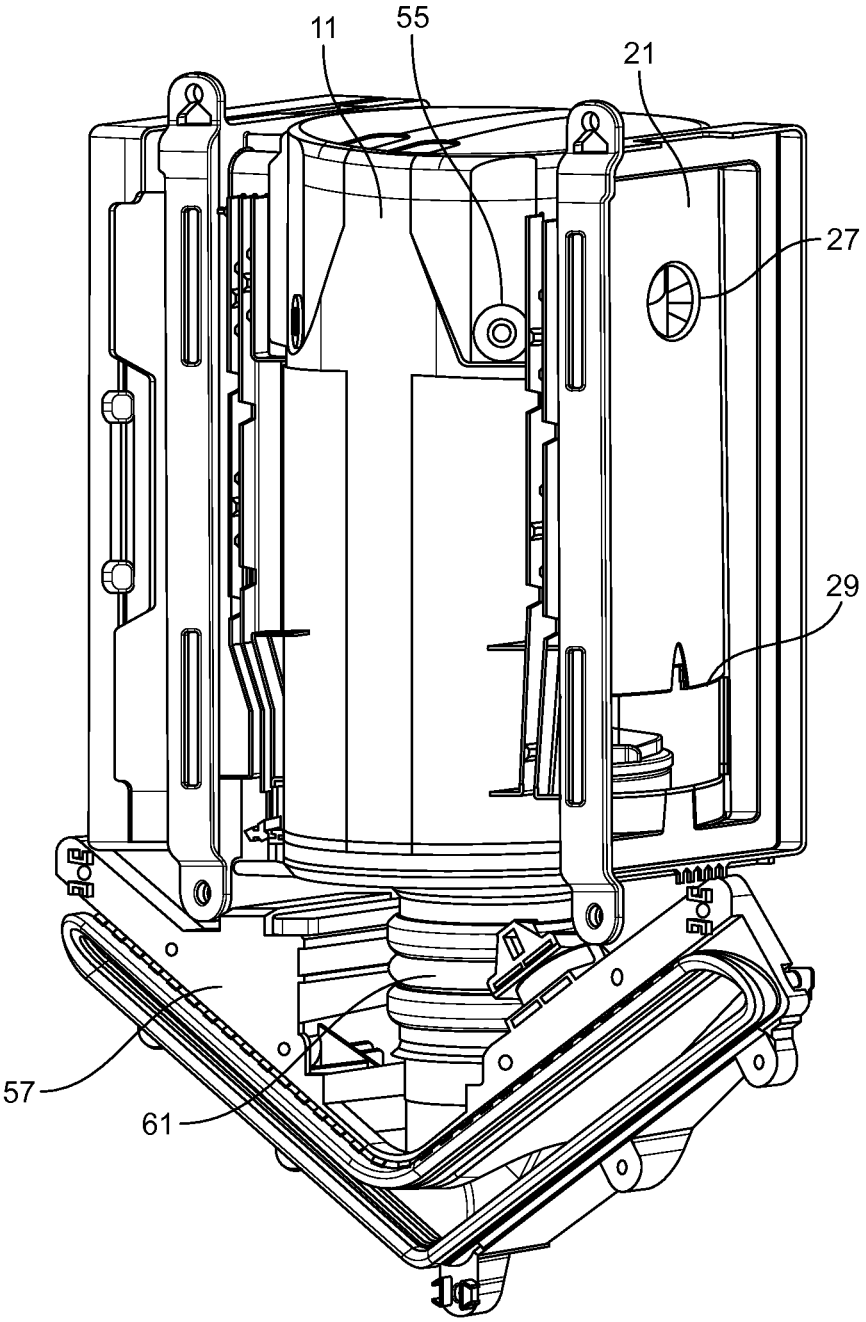
FIG. 8 is a view corresponding to FIG. 7, but with the filter removed.

The lower end of the inflatable duct 43 is secured to a base plate 45, which is hard-mounted to the main back-plate 48 of the dryer (FIG. 6) to provide load-bearing support.

Figure 11:
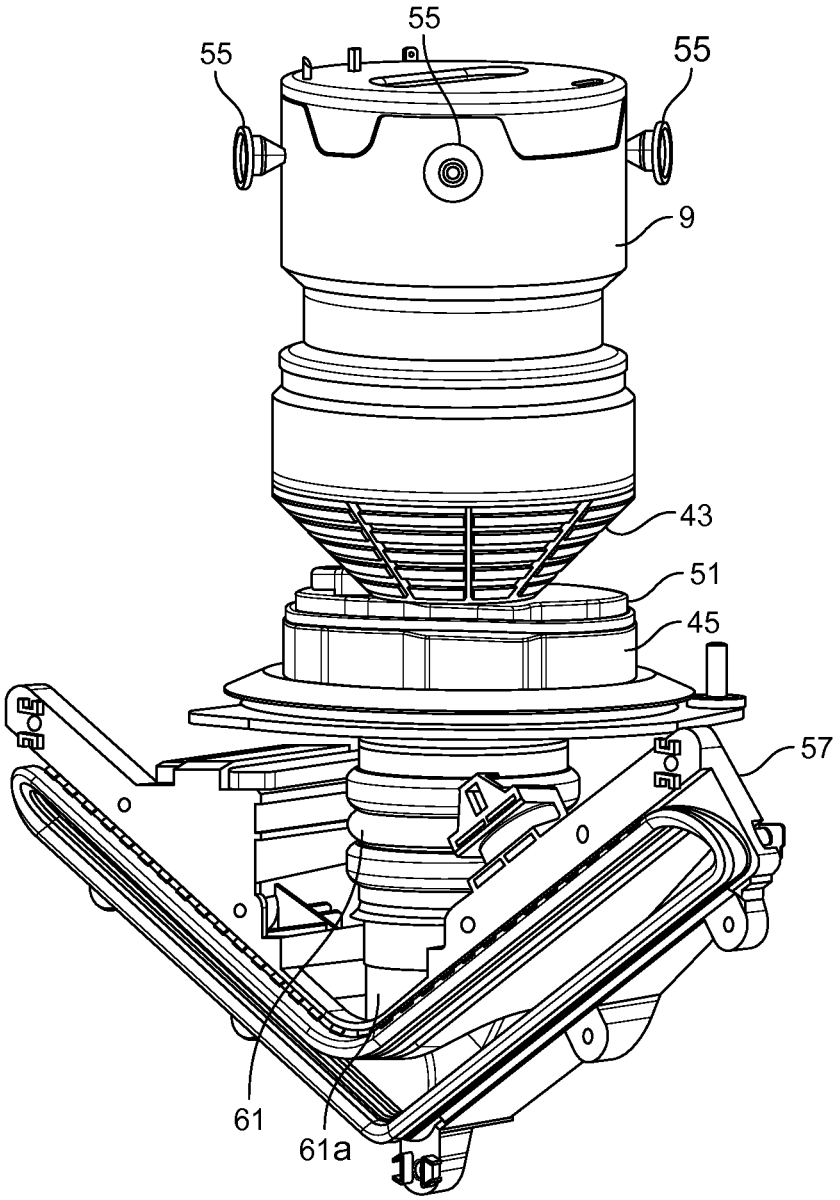
FIG. 11 is a parallel-projected view corresponding to FIG. 9, but with the motor bucket removed entirely to illustrate a plurality of point mounts for the fan unit.
Figure 12:
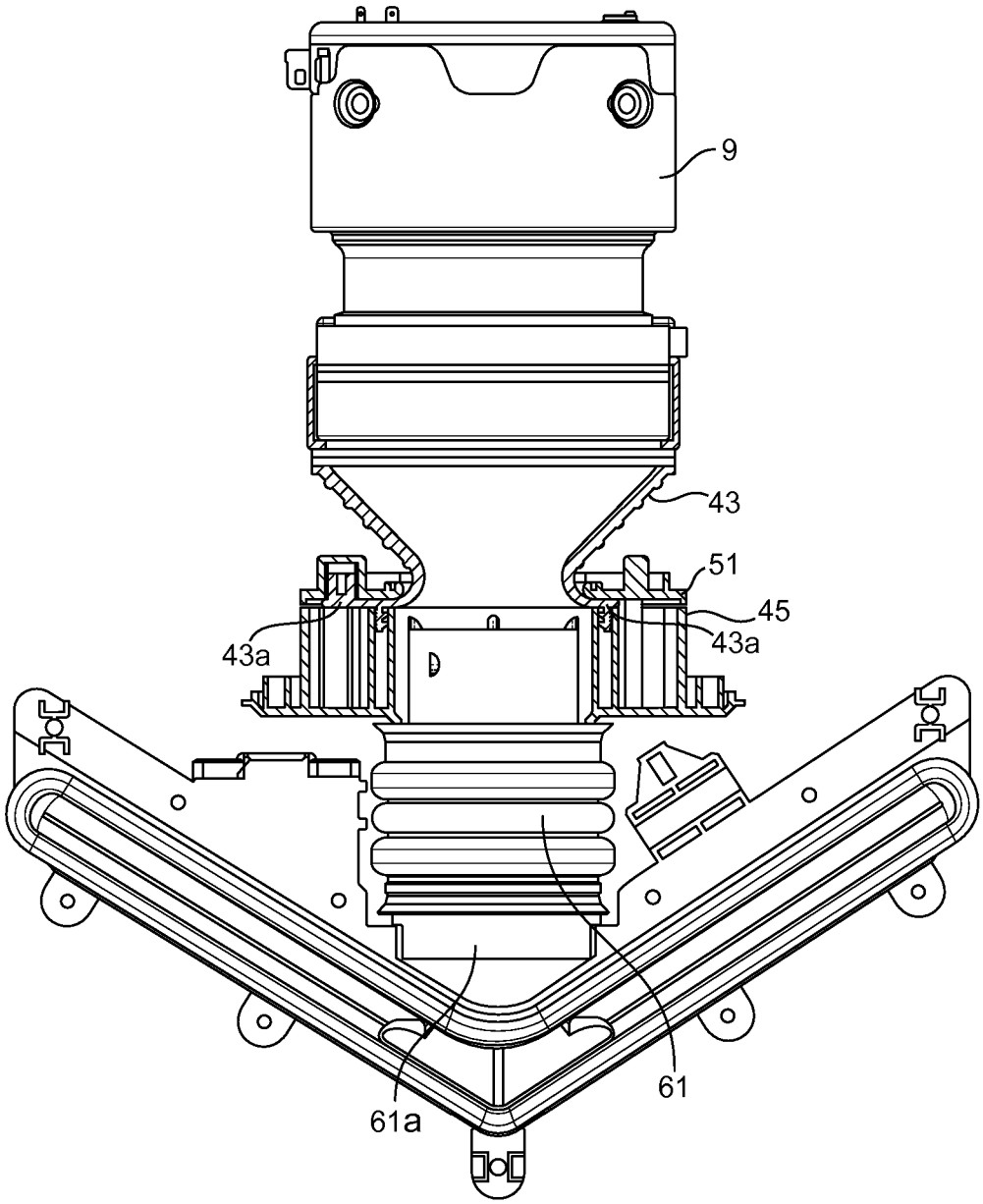
FIG. 12 is a partial-sectional view of certain internal components of the hand dryer, notably the fan unit and a section through the inflatable mount.
Figure 14:
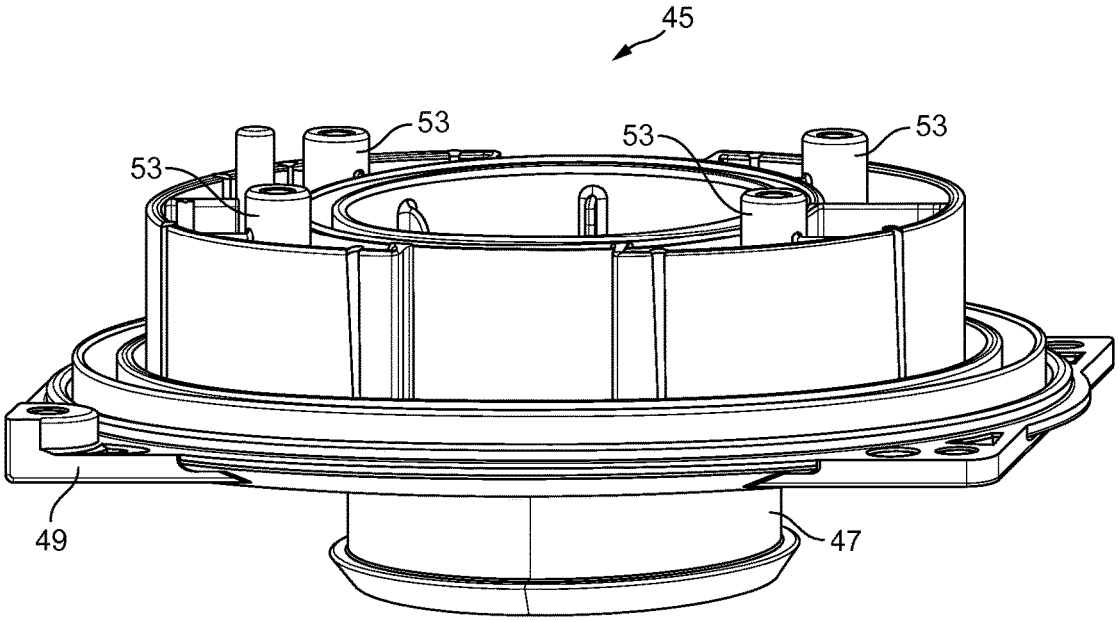
FIG. 14 is a parallel-projected view of a component inside the hand dryer, used to mount the fan unit.

You can see the base plate in FIG. 14. It comprises a central connecting duct 47 surrounded by a mounting platform 49. The lower end of the inflatable duct 43 is seated around the entrance to the connecting duct 47, and secured to the mounting platform 49 by means of a clamping ring 51 (FIG. 11). This clamping ring 51 is screwed down onto the mounting platform 49 (you can see the screw bosses 53 in FIG. 14) and clamps against a flange 43*a* forming part of the lower end of the inflatable duct, which then also acts as a compression seal between the clamping ring 51 and the mounting platform 49.

The upper soft-mounting assembly comprises four "point mounts", taking the form of elastomeric conical supporting members 55.

Each one of the supporting members 55 is mounted, at its base, to the motor bucket 11 and is arranged to extend radially inwardly—relative to the rotation axis A of the impeller—so that the conical vertex of the supporting member 55 makes contact with the external casing of the centrifugal blower 9. The upper soft-mounting assembly thus makes four "point-contacts" with the external casing of the centrifugal blower 9, one for each of the four supporting members 55.

A V-shaped manifold 57 is provided to distribute the airflow to the two air-knife discharge outlets 3, 5. The manifold 57 is screwed onto the internal face of the casing 7, over the top of the air-knife discharge outlets 3, 5. A resilient gasket 59 is used to form a compression seal between the manifold 57 and the casing of the hand dryer.

The manifold 57 is connected to the lower end of the connecting duct 47 on the base plate 45 via a flexible hose 61, which is intended to take up assembly tolerances between the base plate 45 and the manifold 57. One end of the flexible 61 hose push-fits onto the lower end of the connecting duct 47 and the other end of the hose 61 similarly push-fits onto an inlet duct 61*a* forming part of the manifold 57. Cable ties (not shown) may be used at each end of the flexible duct 61 to hold the flexible duct 61 in place.

The combined area of the air-knife discharge outlets 3, 5 is relatively small compared to the area of the fan outlet 41*a*. Consequently, the air-knife discharge outlets 3, 5 constitute a significant flow restriction in the primary airflow path downstream of the fan outlet 41*a*. What happens therefore is that, on start-up of the centrifugal blower 9 there is a significant increase in static pressure downstream of the blower 9. This has the effect of pressurizing the inflatable duct 43, which consequently acts as a pneumatic supporting column for the centrifugal blower 9, helping to limit displacement of the blower 9 and to dampen motor vibrations caused by rotor imbalance etc.

Because the primary airflow is used to pressurize the inflatable duct 43 on start-up of the blower 9, the arrangement is relatively simple: no bleed paths, valves or separate pneumatic circuit is required.

For a given blower specification, the rate of pressurization of the inflatable duct 43 will depend on the effective volume between the fan outlet 41*a* and the air outlets 3, 5 (the 'working volume'), and also the combined area of the air outlets 13, 15 (the 'discharge area'). Consequently, pressurization of the inflatable mount 43 will generally be more rapid in an air-knife dryer, which will generally have a relatively small discharge area. Here, inflation of the mount may be very rapid for a given working volume—providing a very quick initial damping response.

In use, the supporting members 55 provide effective lateral support for the centrifugal blower 9 (support against axial displacement of the blower 9 is provided almost entirely by the inflatable mount 43). At the same time, the supporting members 55 reduce external vibration transmission by significantly limiting the contact area between the drive unit 33 and the motor bucket 11.

In combination, the supporting members 55 and the inflatable mount 43 together form an effective soft-mounting arrangement for the blower 9 which reduces noise transmission to external parts of the hand dryer 1.

Inflatable Mount

Figure 10:
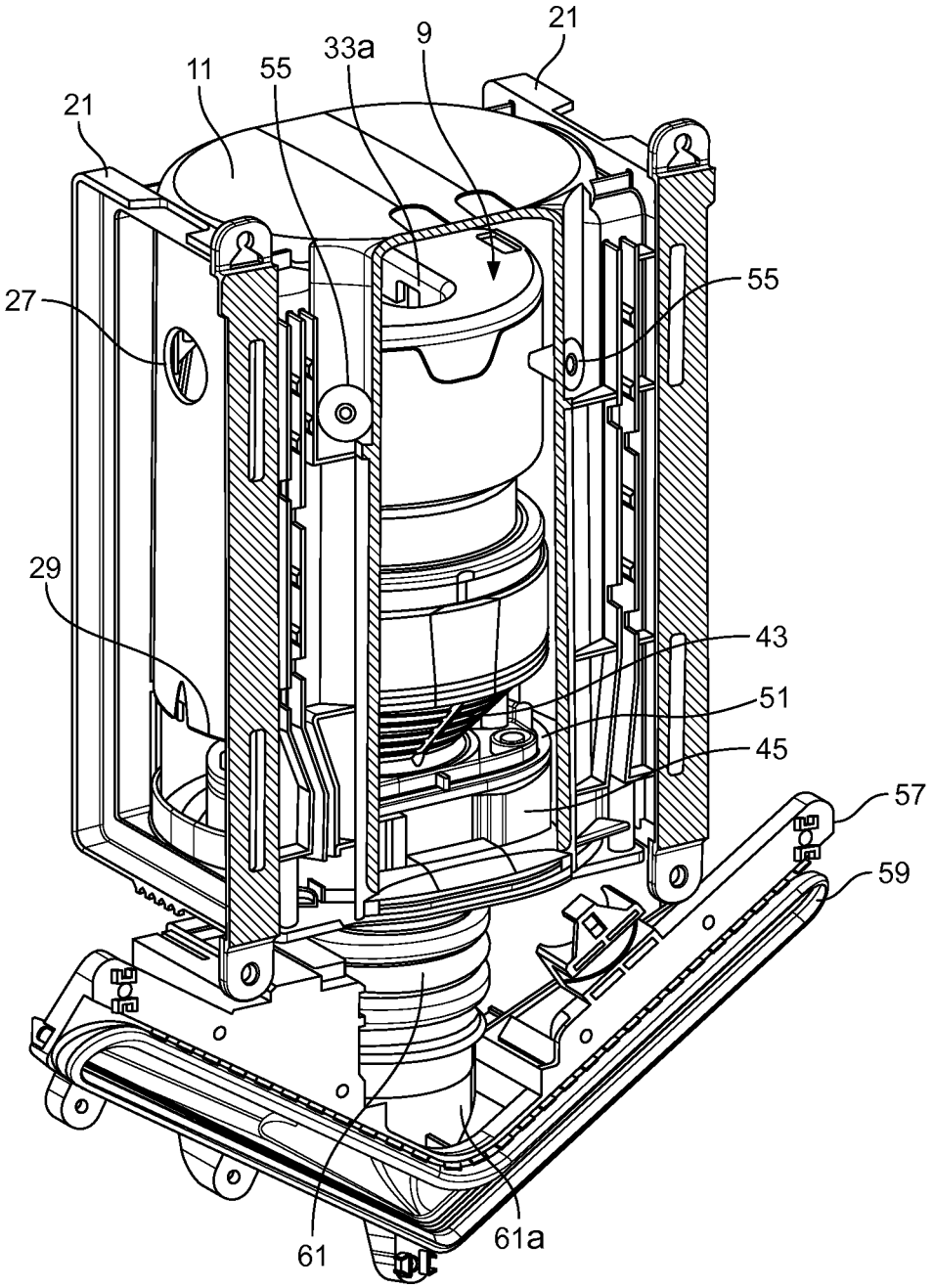
FIG. 10 is a parallel-projected view corresponding to FIG. 9, but from the reverse angle.
Figure 15A:
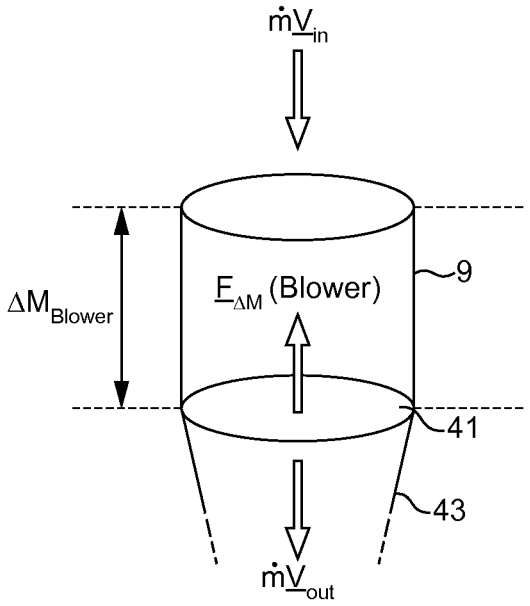
FIG. 15*a* is a schematic illustration of the jet thrust exerted directly on the fan unit.
Figure 15B:
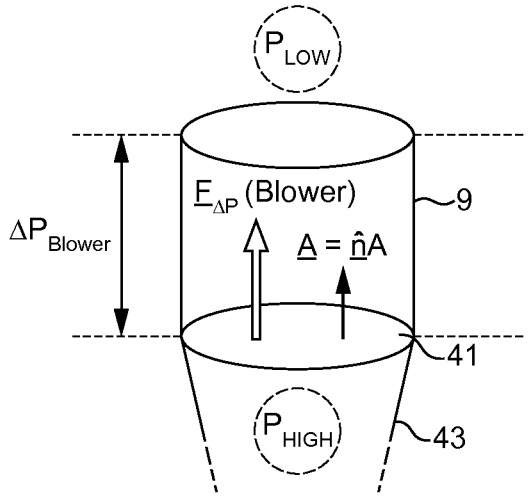
FIG. 15*b* is a schematic illustration of the net pressure force exerted directly on the fan unit.

In use there will be a momentum differential $\Delta M_{Blower}$ across the blower 9, between the blower inlet 33*a* on the drive unit 33 (FIG. 10) and the fan outlet 41*a*. This is illustrated schematically in FIG. 15*a*. In addition to this momentum differential $\Delta M_{Blower}$, there will be a significant static pressure differential $\Delta P_{Blower}$ between the intake and the fan outlet, following pressurization of the working volume downstream of the fan outlet. This is illustrated schematically in FIG. 15*b*.

The momentum differential $\Delta M_{Blower}$ gives rise to a 'jet thrust' $\underline{F}_{\Delta P}$(Blower) which tends to force the blower 9 vertically upwards.

The pressure-differential $\Delta P_{Blower}$ acts on the vector area $\underline{A}$ of the diffuser cap 41—effectively corresponding to the vector area of the inflatable duct 43, adjacent the fan outlet 41*a*—and consequently exerts a net upward pressure force $\underline{F}_{\Delta P}(\text{Blower})=\Delta P_{Blower}\underline{A}$ on the blower 9. This pressure force also tends to force the blower 9 vertically upwards.

Both the jet thrust $\underline{F}_{\Delta M}$ (Blower) and the pressure force $\underline{F}_{\Delta P}$(Blower) exerted on the blower 9 are resisted by the pressurized inflatable duct 43, which secures the blower 9 to the base plate 45. In turn, this places stress on the clamping ring 51 which secures the inflatable duct 43 on the base plate 45.

There will also be a momentum differential $\Delta M_{Duct}$ and pressure differential $\Delta P_{duct}$ between the blower intake and the lower end of the inflatable duct 43. This is illustrated in FIGS. 16*a* and 16*b*.

In this case the momentum differential $\Delta M_{Duct}$ and pressure differential $\Delta P_{Duct}$ exert a force directly on the inflatable duct 43, rather than directly on the blower 9.

Figure 16A:
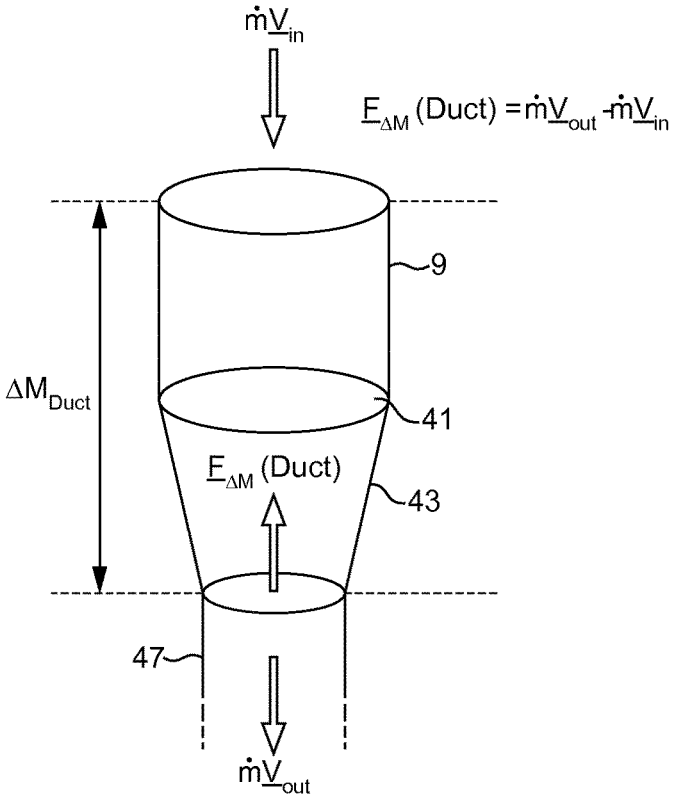
FIG. 16*a* is schematic illustration of the jet thrust exerted directly on the inflatable mount supporting the fan unit.

Referring to FIG. 16*a*, the momentum differential $\Delta M_{Duct}$ gives rise to a jet thrust $\underline{F}_{\Delta M}$ (Duct), which tends to push the inflatable duct 43 upwards against the clamping ring 51.

Figure 16B:
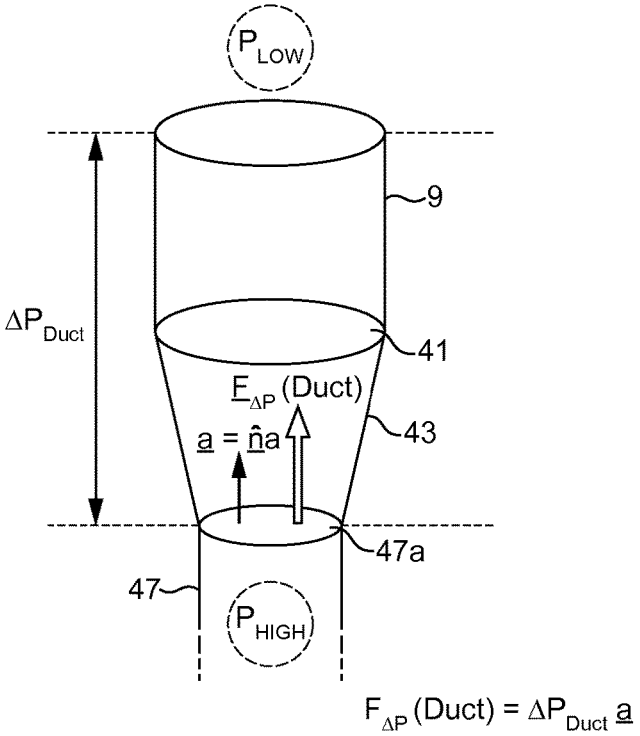
FIG. 16*b* is a schematic illustration of the net pressure force exerted directly on the inflatable mount.

Referring to FIG. 16*b*, the pressure differential $\Delta P_{Duct}$ acts on the vector area $\underline{a}$ of the connecting duct 47, and consequently exerts a net upward pressure force $\underline{F}_{\Delta P}$(Duct)=$\Delta P\underline{a}$ on the inflatable duct 43. This again tends to push the inflatable duct 43 upwards against the clamping ring 51, placing an additional stress on the clamping ring 51.

If the connecting duct 47 had the vector area $\underline{A}$—corresponding to the vector area of the diffuser cap 41—the pressure force $\underline{F}_{\Delta P}$(Duct) exerted directly on the inflatable duct 43 would be of substantially the same magnitude as the pressure force $\underline{F}_{\Delta P}$(Blower) exerted on the blower 9, and the resultant stress on the clamping ring 51 may be significant. To address this problem, the diameter of the connecting duct 47 is instead set so that the magnitude of the vector area $\underline{a}$ of the connecting duct 47 is less than the magnitude of the vector area $\underline{A}$ of the diffuser cap 41. The connecting duct 47 thus effectively defines a fixed orifice 47*a* having a reduced area relative to the area of the diffuser cap 41 (essentially, a deliberate restriction to the airflow). This has the benefit of reducing the magnitude of the pressure force $\underline{F}_{\Delta P}$(Duct) exerted directly on the inflatable duct 43, relative to the pressure force $\underline{F}_{\Delta P}$(Blower) exerted directly on the blower 9. This reduction is achieved independently of the diffuser area A, which can consequently be optimized as part of the blower specification.

Figure 17:
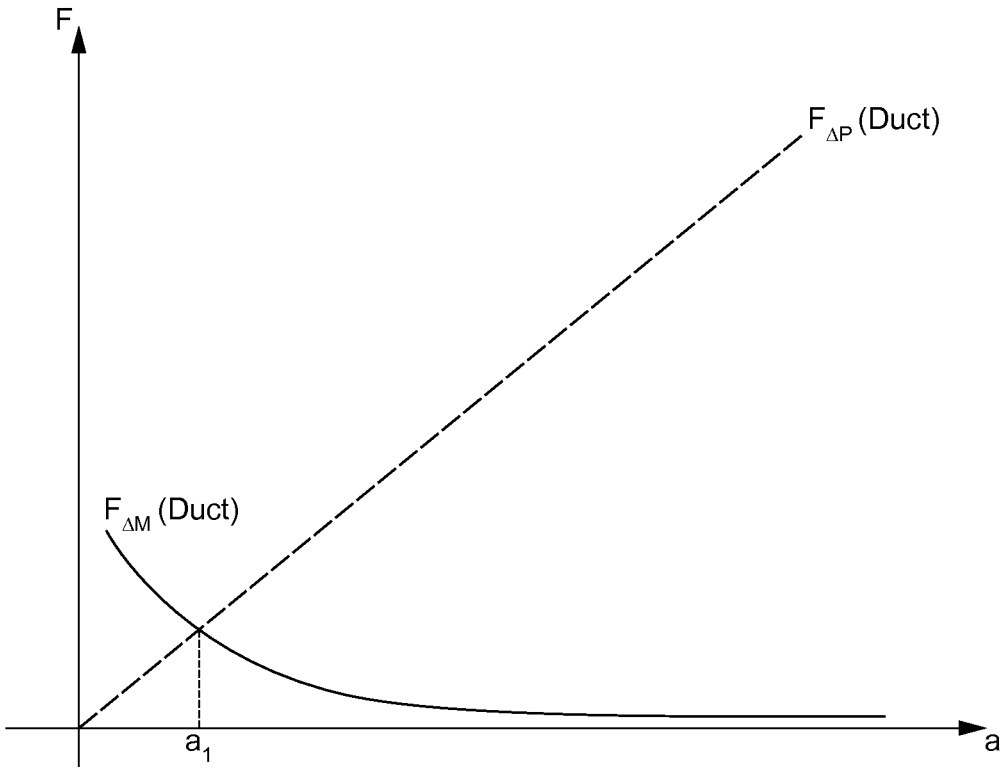
FIG. 17 is a graphical illustration of the pressure force $F_{\Delta P}$(Duct) and jet thrust $F_{\Delta M}$(Duct) as a function of the orifice area a in FIG. 16*b*.

The jet thrust $\underline{F}_{\Delta M}$ (Duct) will also tend to force the inflatable mount 43 upwards. However, the magnitude of the jet thrust $\underline{F}_{\Delta M}$ (Duct) is generally relatively small and remains fairly constant for a wide range of orifice areas. Consequently, a reduction in the pressure force $\underline{F}_{\Delta P}$(Duct) exerted on the inflatable mount 43 can generally be obtained without any corresponding increase in the jet thrust $\underline{F}_{\Delta M}$ (Duct) exerted on the inflatable mount 43. You can see this in FIG. 17, which shows $\underline{F}_{\Delta P}$(Duct) and $\underline{F}_{\Delta M}$ (Duct) as a function of the orifice area a.

At very small orifice areas ($a<a_1$), the jet thrust $\underline{F}_{\Delta M}$ (Duct) may become significant. If the sole intention is to reduce stress on the clamping ring 51, care must be taken not to offset any reduction in the pressure force $\underline{F}_{\Delta P}$(Duct) by an increase in the corresponding jet thrust $\underline{F}_{\Delta M}$ (Duct). Nevertheless, a reduction in the pressure force $\underline{F}_{\Delta P}$(Duct) per se can still advantageously be obtained, even at these small orifice areas.

The invention claimed is:

1. A hand dryer for drying a user's hands, the hand dryer comprising:

an air outlet through which an airflow is discharged from the hand dryer;

a motor-driven fan unit that generates the airflow and comprises a fan outlet through which the airflow exits the motor-driven fan unit;

a fixed part;

an inflatable mount extending between the fan outlet and the air outlet and secured to the fixed part, wherein the inflatable mount comprises at least one inflatable duct that receives the airflow exiting the fan outlet of the motor-driven fan unit and is configured to be inflated by the airflow as it passes through the inflatable duct towards the air outlet to provide pneumatic support for the fan unit.

2. The hand dryer of claim 1, wherein the area of the air outlet is smaller than the area of the fan outlet.

3. The hand dryer of claim 1, wherein the airflow is discharged through the air outlet via an orifice in the fixed part of the hand dryer, the inflatable duct being arranged to connect the fan outlet to the orifice, the area of the orifice being smaller than the cross-sectional area of the inflatable duct adjacent the fan outlet.

4. The hand dryer of claim 1, wherein the fan unit sits on top of the inflatable mount, so that the inflatable mount helps to support the weight of the fan unit.

5. The hand dyer of claim 1, wherein the inflatable mount comprises more than one inflatable duct.

6. The hand dryer of claim 1, wherein the mount takes the form of a single inflatable duct.

7. The hand dryer of claim 6, wherein the fan unit is arranged to sit on top of the inflatable duct, which duct is arranged end-to-end underneath the fan unit to form a pneumatic supporting column.

8. The hand dryer of claim 7, wherein the fan outlet is located on the underside of the fan unit for discharging air directly down into the inflatable duct.

9. The hand dryer of claim 6, wherein the duct is an elastomeric duct.

10. The hand dryer of claim 6, wherein the inflatable duct fits over the outside of the fan unit like a sleeve, the end of the duct being held in place by a collar which mechanically clamps the end of the duct against the outside of the fan unit.

11. The hand dryer of claim 1, wherein the duct is tapered along its length.

12. The hand dryer of claim 11, in which the duct is funnel-shaped.

13. The hand dryer of claim 1, in which the airflow is discharged through the air outlet at a velocity in excess of 80 m/s.

14. The hand dryer of claim 1, in the form of an air-knife hand dryer in which the air outlet is an air-knife discharge outlet.

15. The hand dryer of claim 1, wherein the at least one inflatable duct is funnel-shaped having a cross-section at the top that tapers to a smaller cross-section at the bottom.

* * * * *